United States Patent [19]

Söderhold et al.

[11] Patent Number: 4,679,688

[45] Date of Patent: Jul. 14, 1987

[54] PACKAGE FOR RISK SAMPLES

[76] Inventors: Jan Söderholm, Luntmakargatan 71, 1 tr, Stockholm, Sweden, S-113 51; Hugo Cedraeus, Grönviksvägen 187, Bromma, Sweden, S-161 42

[21] Appl. No.: 906,616

[22] Filed: Sep. 10, 1986

Related U.S. Application Data

[63] Continuation of Ser. No. 734,274, filed as PC7SE 84/00295, Sep. 12, 1984, published as WO 85/01272, Mar. 25, 1985, abandoned.

[51] Int. Cl.[4] ..... B65D 81/26

[52] U.S. Cl. ..... 206/204; 206/232; 206/521; 229/72; 383/38; 383/40; 383/84

[58] Field of Search ..... 206/204, 232, 459, 521, 206/616, 617, 618; 383/38, 40, 84, 109, 110, 113; 229/70, 71, 72

[56] References Cited

U.S. PATENT DOCUMENTS

| | | | |
|---|---|---|---|
| 892,074 | 6/1908 | Obiei | 383/84 |
| 1,896,425 | 2/1933 | Scarfi | 206/618 |
| 2,344,369 | 3/1944 | Sagisberg | 383/38 |
| 2,518,711 | 8/1950 | Mulford | 383/106 |
| 2,710,037 | 6/1955 | Caldwell | 383/106 |
| 2,791,040 | 5/1957 | Santorelli | 383/40 |
| 2,793,743 | 5/1957 | Lefebure | 383/40 |
| 3,142,599 | 7/1964 | Chauannes | 206/522 |
| 3,175,553 | 3/1965 | Mattson | 383/38 |
| 3,224,640 | 12/1965 | Schneider et al. | 383/40 |
| 3,638,784 | 2/1972 | Bodolay et al. | 383/38 |
| 3,790,070 | 2/1974 | Schnitzer et al. | 229/70 |
| 3,811,613 | 5/1974 | Harrison | 383/74 |
| 3,844,409 | 10/1974 | Bodolay et al. | 206/232 |
| 3,868,056 | 2/1975 | Keren | 206/521 |
| 3,939,971 | 2/1976 | Tulis | 383/38 |
| 3,999,700 | 12/1976 | Chalmers | 229/71 |
| 4,084,689 | 4/1978 | Yamagata | 383/84 |
| 4,087,002 | 5/1978 | Bambara et al. | 206/523 |
| 4,189,053 | 2/1980 | Stagnitto et al. | 383/106 |
| 4,205,750 | 6/1980 | Dews | 206/521 |
| 4,213,528 | 7/1980 | Kreutz et al. | 206/204 |

FOREIGN PATENT DOCUMENTS

| | | |
|---|---|---|
| 0060047 | 9/1982 | European Pat. Off. . |
| 2164152 | 9/1972 | Fed. Rep. of Germany . |
| 48337 | 5/1974 | Finland . |
| 2163311 | 7/1973 | France . |
| 2415943 | 8/1979 | France . |
| 385570 | 7/1976 | Sweden . |

*Primary Examiner*—Joseph M. Moy
*Assistant Examiner*—David T. Fidei
*Attorney, Agent, or Firm*—Shapiro and Shapiro

[57] ABSTRACT

The invention relates to a package with shock-absorbing material for shipment of risk samples contained, for instance, in a primary package. The package of the invention includes a shock-absorbing, translucent inner casing with liquid-absorbing material therein and a partly translucent outer casing with a cover flap which seals both the inner and outer casings. A specification or other document may be inserted in a compartment intermediate the respective casings, and means are provided to prevent reading of the document from the outside.

10 Claims, 2 Drawing Figures

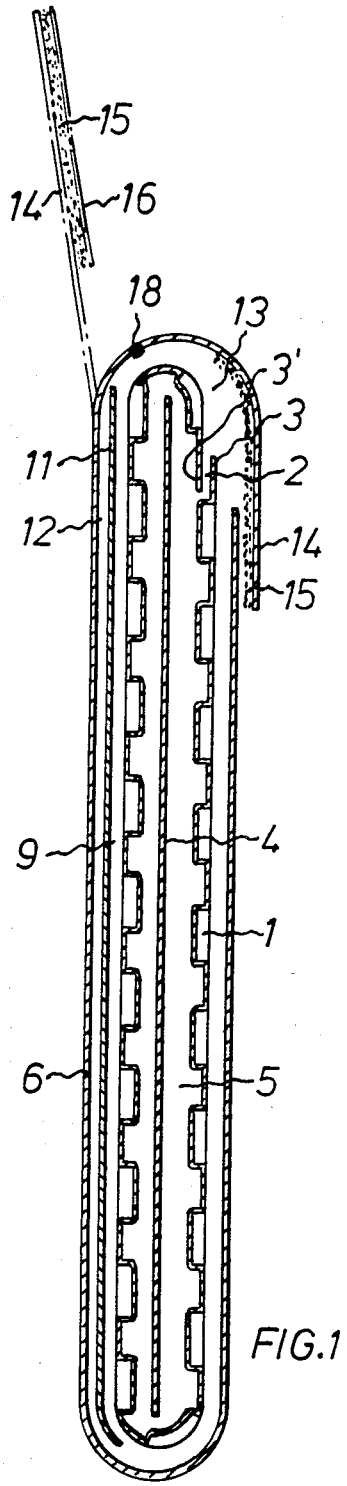
FIG.1
FIG.2
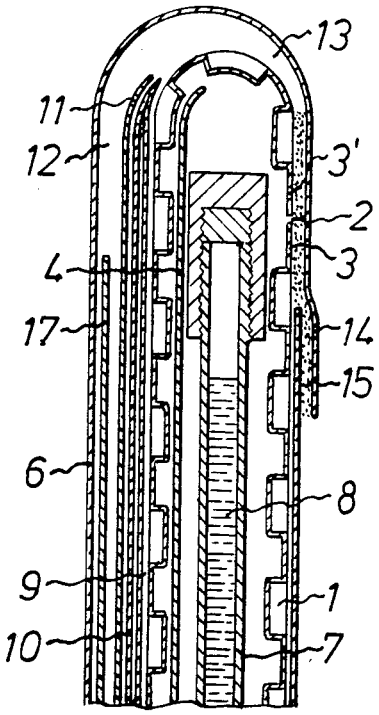

PACKAGE FOR RISK SAMPLES

This is a continuation of application Ser. No. 734,274 filed Apr. 30, 1985, now abandoned.

BACKGROUND OF THE INVENTION

The invention relates to a package with shock-absorbing material for shipment of samples contained in a primary package.

Various so-called risk samples, such as microbiological samples, chemicals, infectious substances, radioactive substances, nasty-smelling masses or material that is disagreeable for one reason or another, contained in so-called primary packages must sometimes be shipped by post, messenger, courier or some other way. In this connection certain directions, announcements, provisions, etc. are to be observed. For instance, infectious samples must be prevented from leaking out through the outer package if the primary package is or has become unsealed.

Enclosed with the package is usually a covering letter, a specification, a referral or other message which must not either be infected, contaminated or come into contact in any other way with the sample in question, if the sample container should not be tight or not be carefully sealed. It should not be possible to read the specification from the outside, i.e. not without opening the package, but in certain cases it should be possible to identify it from the outside. Moreover, the package must fulfil certain criteria for shock resistance, dust-proofing, tightness, etc. It should also be possible to inspect the sealed package from the outside and thus ascertain whether or not the sample in question has leaked out from its primary package. After sealing, the sample pocket must be isolated from the exterior, and leakage from the sample pocket into the specification pocket must also be prevented. Further, it must be possible to indicate the sender and addressee on the sample bag and possibly also other notations, e.g. warning notices. Often it is required that the package should not be difficult to open. It should preferably also be easy to manufacture in large quantities and be inexpensive.

Thus, on one hand, the sample package must be very tight and shock-protected. On the other hand, it must be easy to open and in any case it should be possible to take out the specification or like notes without making it necessary to open at the same time the sample compartment that may possibly contain a leaked-out sample.

SUMMARY OF THE INVENTION

The object of the invention is to provide a package primarily for samples of the above-mentioned type, fulfilling to the greatest possible extent the above criteria and being inexpensive and easy to manufacture in large quantities. It should also be possible to apply a clearly visible warning text and/or other texts and it should be possible to ascertain any leakage from the primary package in the sample pocket without any risk of someone coming in contact with the leakage.

This object is achieved by the present invention through the provision of a package having a shock absorbent first casing with a slit shaped opening and a sample compartment which may be visually checked and having an at least partially translucent second casing containing the first casing and defining therewith an intermediate compartment for insertion of a specification or other document, with means being provided for preventing reading of the document from the outside. The second casing further has a slit shaped opening in communication with the sample compartment and the intermediate document compartment and further has an adhesive cover flap with a removable protective tape, the cover flap being foldable over the respective slit shaped openings of the two casings in such a manner that with the protective tape removed, the cover flap effects a liquid-tight and gas-tight seal of the opening of the first casing and attaches adhesively to the second casing to seal the opening thereof. Further details of the invention will become apparent hereinafter.

BRIEF DESCRIPTION OF THE DRAWING

The invention will now be described in greater detail with reference to the accompanying drawing, in which:

FIG. 1 is a cross-section through an empty package according to the invention; and FIG. 2 is a similar cross-section through the upper part of a package according to the invention, including a sample contained in a primary package in sealed condition.

DESCRIPTION OF THE PREFERRED EMBODIMENTS

As is seen in FIG. 1 the package includes an inner casing 1 of shock-absorbing material, e.g. so-called blister foil. This blister foil consists of translucent plastic foils welded or glued together so as to form a large number of small tablet-size air cushions. It will be appreciated that the term "translucent" is used herein to connote a degree of clarity (of the associated material) sufficient to effectuate the goals of the invention—for example, to allow visual inspection of a risk sample sealed within the package. The casing 1 has a slit-like opening 2 having edges 3, 3' overlapping each other according to FIG. 1 or which may be situated substantially edge to edge according to FIG. 2. Arranged in the inner casng 1 is a liquid-absorbing material 4, in this case in the form of a sheet of blotting-paper. Instead of blotting-paper use may be made of other liquid-absorbing materials, e.g. powder or gels such as recently developed super-absorbing gels of modified starch or fibre sheets impregnated with such starch. The absorbent may advantageously be of such a nature as to change color on contact with a sample.

The inner casing 1 may consist of a blister foil sheet which is folded up according to FIG. 1 and welded together at the edges extending in parallel with the section plane of the drawing, and it may either lie loose or be welded into an outer casing 6. The inner casing 1 includes a pocket 5 into which a sample 8 packed in a primary package 7 is to be inserted, as is seen in FIG. 2. The primary package may in turn be put into an outer package, e.g. of glass or plastic with screw cover, in a way not shown in the drawing figures, while a foamed plastic plug may preferably first be placed in the bottom, whereupon the sample is introduced and another foamed plastic plug is put on and the cover is screwed or pressed on.

Between the inner casing 1 and the outer casing 6 there is formed another pocket 9 for a specification, a referral, a covering letter or other message 10. In FIG. 2 this has been represented in the form of a folded sheet. In order that the latter should not be readable from the outside an opaque liner 11 has been inserted in the specification pocket 9. This liner may also be utilized for indication on its outward face of the name and address of the addressee, any warning text required, information about contents, sender, etc. It is also possible to place an outwardly visible address label 17 in the interspace 12 between the liner 11 and the outer casing.

The outer casing 6 is wholly or at least partly translucent and has, an seen at the top of the figures, a slit-shaped opening 13 and a cover flap 14 which for its major part is provided with a self-adhering layer 15 which, prior to use, is covered with a removable protective tape 16. In FIG. 1 the package according to the invention is shown, on one hand, in broken lines with the cover flap 14, the self-adhering layer 15 and the protective tape 16 in upright outstanding position and, on the other hand, in full lines with protective tape 16 removed, and cover flap 14 folded over the opening of the outer casing 6. As is seen in both FIGS. 1 and 2 the edges 3, 3' of the slit-shaped opening 2 will be sealed by the self-adhering layer—after the protective tape 16 has been removed and the layer 15 has been pressed against the understructure—simultaneously as the outer casing is sealed. The difference between FIG. 1 and FIG. 2 is that in the first case the edges 3 and 3' overlap while according to FIG. 2 they are situated more or less edge to edge. As the inner casing is welded at its outer edges and the slit-shaped opening is completely covered by the cover flap 14 with the self-adhering layer 15, there is obtained an entirely hermetic and leakage-free sealing of the inner pocket. The air in the inner pocket will further contribute to the shock-absorbing effect of the package.

If the package is to be opened the outer casing 6 can be split by means of a knife along the transition of the cover-flap 14 with the outer casing or be torn along the upper edge for instance by means of a tear thread 18 glued to it. Thereby only the specification pocket is opened, and the specification, the covering letter or the like may be taken out without opening the inner casing which contains the sample. If also the inner casing is to be opened, the cover flap is pulled off from one side and thus also the contents of the inner pocket will be accessible.

The package according to the invention is very suitable for mass production in large quantities. One way of proceeding is to fold, around a sheet-cut absorbing material 4, a blister foil with the foil edges edge to edge or with a slight overlap, and then to apply the opaque liner 11, which may also be unwound from rolls. Then an outer foil, which is translucent or provided with appropriate printing, with an adhesive protective tape is finally folded over and under the inner pocket and the band thus formed is welded with double transverse weld seams between which the packages are cut. This method of manufacture may be modified by any person skilled in the art without requiring any inventive activity and the package may also be further varied in accordance with the invention within the scope of the appended claims.

We claim:

1. A package useful for shipment of risk samples (8) contained in a primary package (7), including a first casing (1) and a second casing (6) containing the first casing, and characterized in that the first casing (1) is formed with translucent shock absorbent material and defines an internal compartment (5) for receiving a sample (8), said second casing is at least partly translucent and defines together with said first casing a compartment (9) intermediate the respective casings for insertion of a document therein, said first casing and said second casing are arranged such that said internal compartment is visually checkable by viewing through translucent portions of the respective casings, means are provided for preventing reading of the inserted document from outside said second casing, said first casing has a pair of edges (3,3') defining a slit-shaped opening (2) to said internal compartment, said second casing has a slit-shaped opening (13) in communication with the opening of said first casing and with said intermediate compartment, and said second casing further has an adhesive cover flap (14) with a removable protective tape (15), said cover flap being foldable over both the slit-shaped opening of said first casing and the slit-shaped opening of said second casing in such a manner that, with said protective tape removed, said cover flap adhesively seals to said edges (3,3') and effects a liquid and gas-tight seal of said edges, thereby sealing the slit-shaped opening of said first casing, and adhesively seals to said second casing to seal the slit-shaped opening of said second casing.

2. A package as claimed in claim 1, characterized in that the second casing (6) has a writing field which is visible from outside that casing.

3. A package as claimed in claim 1, characterized in that a liquid-absorbing material (4) is provided in the first casing (1).

4. A package as claimed in claim 3, characterized in that the liquid-absorbing material (4) consists of a sheet of blotting-paper, a liquid-absorbing gel or a liquid-absorbing powder.

5. A package as claimed in claim 4, characterized in that the liquid-absorbing material is of such nature that its color will change on contact with the sample (8).

6. A package as claimed in claim 1, characterized in that said preventing means comprises an opaque liner (11) provided in the intermediate compartment (9).

7. A package as claimed in claim 1, characterized in that a tear thread (18) or the like to facilitate opening of said second casing (6) is fitted on the cover flap (14) in parallel with a transition of the cover flap with the second casing.

8. A package as claimed in claim 1, characterized in that said first and second casings (1,6) are quite translucent, said preventing means includes an opaque liner (11) provided in the intermediate compartment (9), and an opaque sheet of liquid-absorbing material is provided in the first casing.

9. A package as claimed in claim 1, characterized in that the second casing (6) has a compartment for insertion of data which are readable by viewing through a translucent portion of that casing.

10. A package as claimed in claim 8, characterized in that the liquid-absorbing material is of such nature that its color will change on contact with the sample (8).

* * * * *